US012780599B2

(12) United States Patent
Xu

(10) Patent No.: US 12,780,599 B2
(45) Date of Patent: Nov. 3, 2026

(54) ROPE WINDING AND UNWINDING DEVICE WITH DUAL-LOCKING FUNCTION

(71) Applicant: Best-in Trading Company, Yangjiang city (CN)

(72) Inventor: Zhenfeng Xu, Yangjiang City (CN)

( * ) Notice: Subject to any disclaimer, the term of this patent is extended or adjusted under 35 U.S.C. 154(b) by 125 days.

(21) Appl. No.: 19/027,453

(22) Filed: Jan. 17, 2025

(65) Prior Publication Data

US 2026/0193052 A1 Jul. 9, 2026

(30) Foreign Application Priority Data

Jan. 4, 2025 (CN) ..... 202520014295.1

(51) Int. Cl.
*B65H 75/44* (2006.01)
*A45F 5/00* (2006.01)
(Continued)

(52) U.S. Cl.
CPC ..... *B65H 75/4431* (2013.01); *B65H 75/406* (2013.01); *B65H 75/4402* (2013.01); *B65H 75/4418* (2013.01); *B65H 75/4428* (2013.01); *B65H 75/4434* (2013.01); *B65H 75/4471* (2013.01); *B65H 75/48* (2013.01); *A45F 5/004* (2013.01); *B65H 75/486* (2013.01); *B65H 2701/35* (2013.01)

(58) Field of Classification Search
CPC .. B65H 75/406; B65H 75/42; B65H 75/4402; B65H 75/4418; B65H 75/4428; B65H 75/4431; B65H 75/4434; B65H 75/4436; B65H 75/4442; B65H 75/4457; B65H 75/4471; B65H 75/48; B65H 75/483; B65H 75/486; B65H 75/34; B65H 75/38; B65H 2701/35; B65H 2701/352; B65H 2701/353; B65H 2701/354; B65H 2701/355; B65H 2701/356; B65H 2701/36; A45F 5/00; A45F 5/002; A45F 5/004; A45F 2005/2006
USPC ..... 242/371, 379, 379.2, 382
See application file for complete search history.

(56) References Cited

U.S. PATENT DOCUMENTS 1,105,680 A * 8/1914 Mitchell ..... B65H 75/486 242/375.1
3,224,706 A * 12/1965 Bastow ..... B65H 75/4431 242/378.1

(Continued)

FOREIGN PATENT DOCUMENTS

KR 101874288 B1 * 7/2018 ..... B65H 75/4428

*Primary Examiner* — Victoria P Augustine
*Assistant Examiner* — Raveen J Dias
(74) *Attorney, Agent, or Firm* — Sandy Lipkin

(57) ABSTRACT

The present application discloses a rope winding and unwinding device with a dual-locking function and relates to the technical field of rope unwinding devices. This device includes a connecting mechanism, a locking mechanism is provided at one side of the connecting mechanism and includes a shell, at least three connecting blocks are provided on an inner wall of one side of the shell, a rotating shaft is fixedly connected to one side of the shell, a rope spool is rotatably connected to an outer wall of the rotating shaft, a sliding groove is formed on an inner wall of one side of the shell, and a locking plate is slidably connected in the sliding groove. According to the present application, double locking is achieved, and the rope is fixed.

6 Claims, 3 Drawing Sheets

(51) Int. Cl.
*B65H 75/40* (2006.01)
*B65H 75/48* (2006.01)

(56) References Cited

U.S. PATENT DOCUMENTS 3,490,715 A * 1/1970 Nicpon ..... F16D 71/00 242/385.3
4,146,191 A * 3/1979 Cavanaugh ..... B65H 75/486 242/380
4,192,078 A * 3/1980 Lore ..... B44D 3/38 33/414
4,202,510 A * 5/1980 Stanish ..... A01K 27/004 242/384.7
4,417,703 A * 11/1983 Weinhold ..... H02G 11/02 242/378.1
4,565,011 A * 1/1986 Karger ..... B44D 3/38 242/375
4,765,557 A * 8/1988 Kahmann ..... B65H 75/4444 33/767
5,509,616 A * 4/1996 Millen, Jr. ..... B65H 75/44 242/385.4
5,699,975 A * 12/1997 Paugh ..... A45F 5/004 242/532.5
5,833,165 A * 11/1998 Paugh ..... A44B 15/005 242/380
5,938,137 A * 8/1999 Poulson ..... B65H 75/48 242/379.2
5,954,288 A * 9/1999 Shih ..... A45F 5/004 242/380
6,098,299 A * 8/2000 Collins ..... B44D 3/38 24/122.3
6,997,410 B1 * 2/2006 Huang ..... B65H 75/4431 242/385.4
7,364,109 B2 * 4/2008 Kuo ..... B65H 75/4434 242/378
7,384,013 B2 * 6/2008 Yen ..... B65H 75/4434 242/378
7,607,603 B1 * 10/2009 Chang ..... H02G 11/02 242/378.1
7,784,727 B1 * 8/2010 Liao ..... H01R 13/72 242/378.1
7,984,799 B2 * 7/2011 Huang ..... H01R 31/06 191/12.2 R
8,191,815 B2 * 6/2012 Huang ..... B65H 75/48 242/379.2
9,630,682 B1 * 4/2017 Yost ..... B63B 21/045
11,033,003 B1 * 6/2021 Burkhardt ..... B65H 75/486
2005/0184186 A1 * 8/2005 Tsoi ..... A43C 11/165 242/378.1
2006/0163412 A1 * 7/2006 Szarkowski ..... B65H 75/4434 242/384
2006/0285939 A1 * 12/2006 Mcduff ..... F16B 45/00 411/135
2009/0014575 A1 * 1/2009 Cheng ..... B65H 75/4434 242/397
2009/0140093 A1 * 6/2009 Wu ..... B65H 75/4434 242/371
2010/0314479 A1 * 12/2010 Kish ..... A01K 27/004 242/376
2012/0153064 A1 * 6/2012 Votel ..... B65H 75/4434 242/378.4
2014/0151486 A1 * 6/2014 Chen ..... B65H 75/4434 242/379
2015/0289634 A1 * 10/2015 Chavez ..... H04B 1/3888 224/162
2015/0312667 A1 * 10/2015 Lei ..... B65H 75/406 242/379
2019/0152739 A1 * 5/2019 Ji ..... H04R 1/1033
2019/0276269 A1 * 9/2019 Castañeda ..... B65H 75/4471
2019/0389687 A1 * 12/2019 Bessac ..... B65H 75/4471
2020/0154869 A1 * 5/2020 Jenkins ..... H04B 1/3888
2020/0399093 A1 * 12/2020 Masaki ..... B65H 75/4471
2021/0076809 A1 * 3/2021 Lucarelli ..... A45C 13/1069
2022/0017325 A1 * 1/2022 Paulsen ..... B65H 75/4431
2022/0055858 A1 * 2/2022 Burke ..... B65H 75/42
2023/0104994 A1 * 4/2023 Golliher ..... A45F 5/004 224/162
2026/0020601 A1 * 1/2026 Dillard ..... A24F 15/18

* cited by examiner

ROPE WINDING AND UNWINDING DEVICE WITH DUAL-LOCKING FUNCTION

REFERENCE TO PRIOR APPLICATION

This application claims priority to Chinese Patent Application 202520014295.1, filed on Jan. 4, 2025, which is incorporated herein by reference.

TECHNICAL FIELD

The present application relates to the technical field of rope unwinding devices, and specifically to a rope winding and unwinding device with a dual-locking function.

BACKGROUND

Chinese Patent Application Publication No. CN113562142A discloses a rope unwinding device, which includes: a front support panel and a rear support panel provided at an interval in front and back, wherein a middle upper shaft, a left lower shaft and a right lower shaft are provided between the front support panel and the rear support panel, a left roller positioned between the front support panel and the rear support panel is sleeved on the left lower shaft, a right roller positioned between the front support panel and the rear support panel is sleeved on the right lower shaft, a rope control plate capable of rotating around the middle upper shaft is sleeved on the middle upper shaft, a clamping and locking part matched with the left roller is formed at a lower left corner of the rope control plate, a driving part matched with the right roller is formed at a lower right corner of the rope control plate, a rope supporting and reinforcing and limiting module provided between the left roller and the right roller is detachably connected to the front support panel and the rear support panel, and a front side of this module abuts against the front support panel and a rear side of this module abuts against the rear support panel to prevent the rope from collapsing downward. This device is safer, more reliable and easier to operate.

However, during the use of the above device, due to the configuration of the front support panel and the rear support panel, a single locking device cannot maintain the stability of the rope under extreme conditions, which reduces the safety. Therefore, in view of this situation, a more convenient and practical rope winding and unwinding device is proposed to meet the use requirement.

SUMMARY

An objective of the present application is to provide a rope winding and unwinding device with a dual-locking function, so as to solve the problems in the background.

To achieve the above objective, the present application provides the following technical solution. A rope winding and unwinding device with a dual-locking function includes a connecting mechanism configured to connect to a rope, a locking mechanism is provided at one side of the connecting mechanism and configured to lock the rope, the locking mechanism includes a shell, at least three connecting blocks are provided on an inner wall of one side of the shell, a rotating shaft is fixedly connected to one side of the shell, a rope spool is rotatably connected to an outer wall of the rotating shaft, a sliding groove is formed on an inner wall of one side of the shell, a locking plate is slidably connected in the sliding groove, the locking plate is rotatably connected to the rotating shaft, and a locking assembly is provided in the rope spool.

Further, the connecting mechanism includes a fixed ring, and a connecting ring is rotatably connected to an inner wall of the fixed ring.

Further, a damping buckle is mounted at one side of the connecting ring.

Further, the locking assembly includes three island members, and the three island members divide an inner wall of the rope spool into an inner channel and an outer channel.

Further, a sliding column is fixedly connected to one side of the locking plate, and the sliding column slides along the three island members.

Furthermore, a notch is formed on one side of the shell, an expanded head is slidably connected in the notch, a connecting rod is fixedly connected to an outer wall of the expanded head, and a pulling ring is fixedly connected to one end of the connecting rod.

Compared with the prior art, the present application has the following beneficial effects.

According to this rope winding and unwinding device with a dual-locking function, the connecting mechanism and locking mechanism are provided, when the rope spool rotates driven by the rope, the three island members rotate accordingly, which guides the sliding column on the locking plate, so that the locking plate slides left and right in the sliding groove; since there is a groove on the three island members that can clamp the sliding column on the locking plate, the rope spool rotates counterclockwise when the rope is pulled, and the sliding column does not fall into the groove and is not locked; when the rope spool rotates clockwise under the action of an internal spring to wind the rope, there are two situations: when the sliding column is positioned at the outer channel, the sliding column does not fall into the groove under the guidance of the three island members, that is, the sliding column is not locked; and when the sliding column is positioned at the inner channel, the sliding column inevitably falls into the groove within one rotation under the guidance of the three islands member, that is, the sliding column is locked. In this case, the winding action is stopped, and the function of locking the rope at a certain length is achieved. In this case, if the recovery of the rope winding function is required, the rope can be pulled once to make the sliding column move to the outer channel. If the length adjustment of the locked rope is required, the rope can be pulled twice to get a desired length. This device provides a dual-locking mechanism, which can keep the rope fixed even in extreme situations, greatly improving safety, has strong practicality, and is suitable for promotion.

Meanwhile, the connecting mechanism ensures the firm connection between the rope and the device, can effectively bear the tension and the impact force, and increases the safety during the using process.

Figure 1:
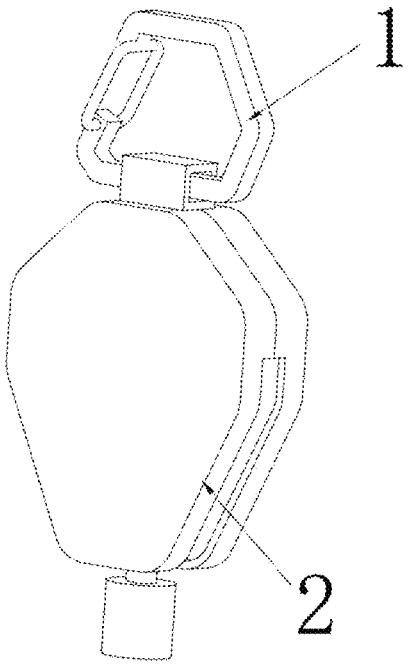
FIG. 1 is a schematic diagram of a structure of an entire mechanism according to the present application.

Reference numerals: 1: connecting mechanism; 101: fixed ring; 102: connecting ring; 103: damping buckle; 2: locking mechanism; 201: shell; 202: connecting block; 203: rope spool; 204: sliding groove; 205: rotating shaft; 206: three island members; 207: outer channel; 208: inner channel; 209: locking plate; 210: sliding column; 211: expanded head; 212: connecting rod; and 213: pulling ring.

DETAILED DESCRIPTION OF EMBODIMENTS

The technical solutions in the embodiments of the present application will be clearly and completely described below with reference to the drawings in the embodiments of the present application. It is apparent that the described embodiments are only some, but not all, embodiments of the present application. Based on the embodiments of the present application, all other embodiments obtained by those of ordinary skill in the art without creative efforts fall within the protection scope of the present application.

The rope winding and unwinding device is used during high-altitude operations. The rope winding and unwinding device provided by the present application is specially used for rope winding and unwinding operation in the process of high-altitude operation. Before using this device for rope winding and unwinding operations each time, the connecting mechanism 1 and the locking mechanism 2 should be checked for proper operation to ensure that the rope is securely connected so as to avoid accidents caused by improper connection. Exceeding the design load capacity is avoided to prevent device damage or danger. The device is kept clean to avoid dirt and foreign matter accumulating on key components that affect the normal operation of the device. Whether there is wear, aging or damage is checked regularly, and damaged parts are replaced in time if necessary.

Figure 2:
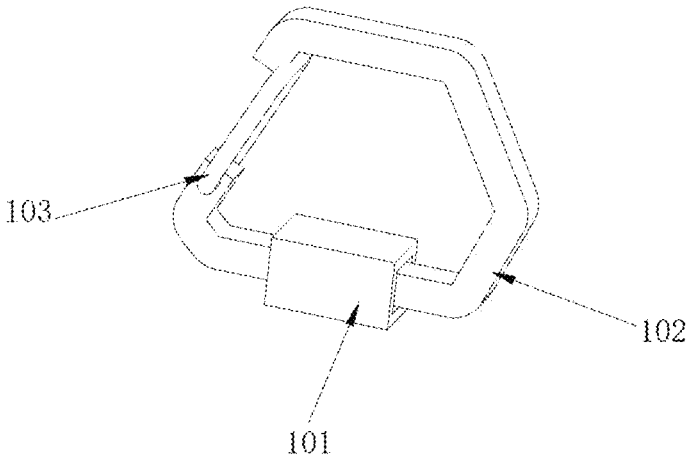
FIG. 2 is a schematic diagram of a structure of a connecting mechanism according to the present application.
Figure 3:
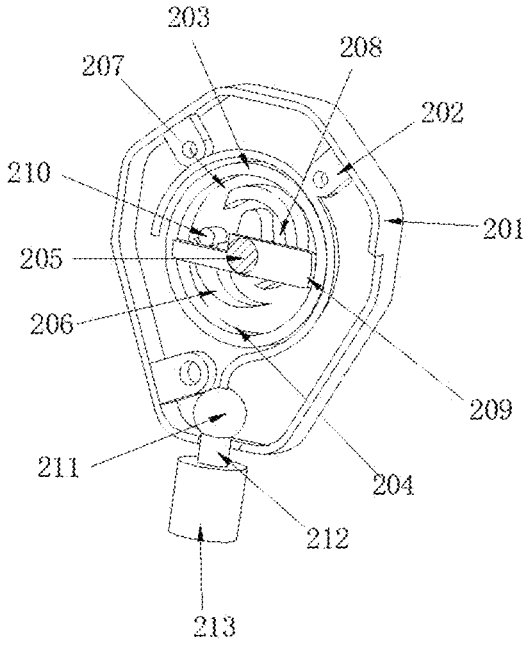
FIG. 3 is a schematic diagram of a cross-sectional structure of a locking mechanism according to the present application.

As shown in FIGS. 1 to 3, the present application provides a technical solution. A rope winding and unwinding device with a dual-locking function includes a connecting mechanism 1 configured to connect to a rope, a locking mechanism 2 is provided at one side of the connecting mechanism 1 and configured to lock the rope, the locking mechanism 2 includes a shell 201, at least three connecting blocks 202 are provided on an inner wall of one side of the shell 201, a rotating shaft 205 is fixedly connected to one side of the shell 201, a rope spool 203 is rotatably connected to an outer wall of the rotating shaft 205, a sliding groove 204 is formed on an inner wall of one side of the shell 201, a locking plate 209 is slidably connected in the sliding groove 204, the locking plate 209 is rotatably connected to the rotating shaft 205, a locking assembly is provided in the rope spool 203, the locking assembly includes three island members 206, the three island members 206 divide an inner wall of the rope spool 203 into an inner channel 208 and an outer channel 207, a sliding column 210 is fixedly connected to one side of the locking plate 209, the sliding column 210 slides along the three island members 206, a notch is formed on one side of the shell 201, an expanded head 211 is slidably connected in the notch, a connecting rod 212 is fixedly connected to an outer wall of the expanded head 211, and a pulling ring 213 is fixedly connected to one end of the connecting rod 212.

It should be noted that, during the use, when the rope spool 203 rotates driven by the rope, the three island members 206 rotate accordingly, which guides the sliding column 210 on the locking plate 209, so that the locking plate 209 slides left and right in the sliding groove 204; since there is a groove on the three island members 206 that can clamp the sliding column 210 on the locking plate 209, the rope spool 203 rotates counterclockwise when the rope is pulled, and the sliding column 210 does not fall into the groove and is not locked; when the rope spool 203 rotates clockwise under the action of an internal spring to wind the rope, there are two situations: when the sliding column 210 is positioned at the outer channel 207, the sliding column 210 does not fall into the groove under the guidance of the three island members 206, that is, the sliding column is not locked; and when the sliding column 210 is positioned at the inner channel 208, the sliding column 210 inevitably falls into the groove within one rotation under the guidance of the three islands member 206, that is, the sliding column is locked. in this case, the winding action is stopped, and the function of locking the rope at a certain length is achieved; if the recovery of the rope winding function is required, the rope can be pulled once to make the sliding column 210 move to the outer channel 207, if the length adjustment of the locked rope is required, the rope can be pulled twice to get a desired length. Finally, the pulling ring 213 is manually controlled to control the expanded head 211 to slide in the shell 201 through the connecting rod 212 to adjust the angle. The locking mechanism 2 can easily adjust the state of the locking plate 209 to achieve rapid adjustment of the tightness of the rope to meet different work requirements.

As shown in FIG. 2, the connecting mechanism 1 includes a fixed ring 101, a connecting ring 102 is rotatably connected to an inner wall of the fixed ring 101, and a damping buckle 103 is mounted on one side of the connecting ring 102.

It should be noted that, during the using process, the fixed ring 101, the shell 201 and the connecting member are firstly connected, then the damping buckle 103 is manually operated to connect the connecting ring 102 and the connecting member, and finally the connecting mechanism 1 and the connecting member are connected, so that the connecting mechanism 1 ensures the firm connection between the rope and the device, can effectively bear the tension and the impact force, and increases the safety during the using process.

Although the embodiments of the present application have been shown and described, it may be understood by those of ordinary skill in the art that various changes, modifications, substitutions, and alterations may be made to these embodiments without departing from the principle and purpose of the present application, and the scope of the present application is defined in the embodiments and equivalents thereof.

What is claimed is:

1. A rope winding and unwinding device with a dual-locking function, comprising a connecting mechanism (1) configured to connect to a rope, wherein a locking mechanism (2) is provided at one side of the connecting mechanism (1) and configured to lock the rope, the locking mechanism (2) comprises a shell (201), at least three connecting blocks (202) are provided on an inner wall of one side of the shell (201), a rotating shaft (205) is fixedly connected to one side of the shell (201), a rope spool (203) is rotatably connected to an outer wall of the rotating shaft (205), a sliding groove (204) is formed on an inner wall of one side of the shell (201), a locking plate (209) is slidably connected in the sliding groove (204), the locking plate (209) is rotatably connected to the rotating shaft (205), and a locking assembly is provided in the rope spool (203).

2. The rope winding and unwinding device with the dual-locking function according to claim 1, wherein the connecting mechanism (1) comprises a fixed ring (101), and a connecting ring (102) that is rotatably connected to an inner wall of the fixed ring (101).

3. The rope winding and unwinding device with the dual-locking function according to claim 2, wherein a damping buckle (103) is mounted on one side of the connecting ring (102).

4. The rope winding and unwinding device with the dual-locking function according to claim 1, wherein the locking assembly comprises three island members (206), and the three island members (206) divide an inner wall of the rope spool (203) into an inner channel (208) and an outer channel (207).

5. The rope winding and unwinding device with the dual-locking function according to claim 4, wherein a sliding column (210) is fixedly connected to one side of the locking plate (209), and the sliding column (210) slides along the three island members (206).

6. The rope winding and unwinding device with the dual-locking function according to claim 1, wherein a notch is formed on one side of the shell (201), an expanded head (211) is slidably connected in the notch, a connecting rod (212) is fixedly connected to an outer wall of the expanded head (211), and a pulling ring (213) is fixedly connected to one end of the connecting rod (212).

* * * * *